US007904995B2

(12) United States Patent
Bois

(10) Patent No.: US 7,904,995 B2
(45) Date of Patent: Mar. 15, 2011

(54) BI-MATERIAL CLOSURE DEVICE FOR A BAG

(75) Inventor: Henri Bois, Neuilly sur Seine (FR)

(73) Assignee: S2F Flexico, Henonville (FR)

( * ) Notice: Subject to any disclaimer, the term of this patent is extended or adjusted under 35 U.S.C. 154(b) by 105 days.

(21) Appl. No.: 11/399,794

(22) Filed: Apr. 7, 2006

(65) Prior Publication Data

US 2006/0229183 A1 Oct. 12, 2006

(30) Foreign Application Priority Data

Apr. 8, 2005 (FR) ..... 05 03516

(51) Int. Cl.
*A44B 19/16* (2006.01)
*B65D 33/16* (2006.01)

(52) U.S. Cl. ..... 24/399; 24/585.11; 24/585.12; 383/63

(58) Field of Classification Search ..... 24/399, 24/389, 400, 585.11, 585.12; 383/63; 428/100
See application file for complete search history.

(56) References Cited

U.S. PATENT DOCUMENTS 1,703,712 A 2/1929 Aud
2,978,769 A 4/1961 Harrah
3,425,469 A * 2/1969 Ausnit ..... 383/65
3,827,472 A * 8/1974 Uramoto ..... 383/204
3,959,856 A * 6/1976 Ausnit ..... 24/399
4,285,376 A * 8/1981 Ausnit ..... 383/203
4,731,911 A * 3/1988 Gould ..... 24/585.12
5,248,201 A * 9/1993 Kettner et al. ..... 24/DIG. 50
5,252,281 A * 10/1993 Kettner et al. ..... 264/173.17
5,356,222 A * 10/1994 Kettner et al. ..... 24/DIG. 50
5,403,094 A * 4/1995 Tomic ..... 383/63
5,429,875 A * 7/1995 Okamoto et al. ..... 24/306
5,436,051 A * 7/1995 Donaruma et al. ..... 428/100
5,540,970 A * 7/1996 Banfield et al. ..... 428/100
5,689,866 A * 11/1997 Kasai et al. ..... 24/585.12
5,774,955 A * 7/1998 Borchardt et al. ..... 24/584.1
5,794,315 A * 8/1998 Crabtree et al. ..... 24/30.5 R
5,817,380 A * 10/1998 Tanaka ..... 428/100
5,819,391 A * 10/1998 Matsushima et al. ..... 24/452
5,991,980 A * 11/1999 Meager ..... 24/400
6,154,934 A * 12/2000 Matthews ..... 24/585.1
6,953,542 B2 * 10/2005 Cisek ..... 264/210.2
2004/0136617 A1 7/2004 Gerrits
2004/0187273 A1 9/2004 Meager

* cited by examiner

*Primary Examiner* — Robert J Sandy
(74) *Attorney, Agent, or Firm* — Blakely, Sokoloff, Taylor & Zafman LLP

(57) ABSTRACT

A closure assembly includes two complementary zippers, respectively with support backing-strips (220) and complementary closure elements (242), wherein at least one of these closure elements includes a widened soleplate (246) that is at least partially surrounded by the associated support backing-strip (220).

17 Claims, 2 Drawing Sheets

BI-MATERIAL CLOSURE DEVICE FOR A BAG

This present invention concerns the area of closure zippers designed to perform multiple opening and closing of bags.

Figure 1:
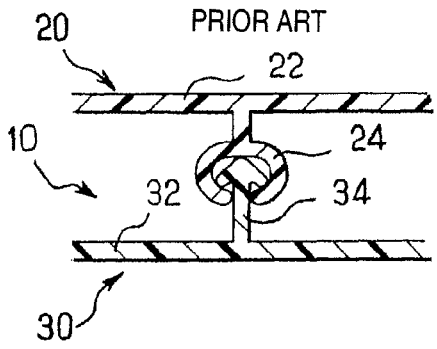
FIG.1 PRIOR ART
Figure 2:
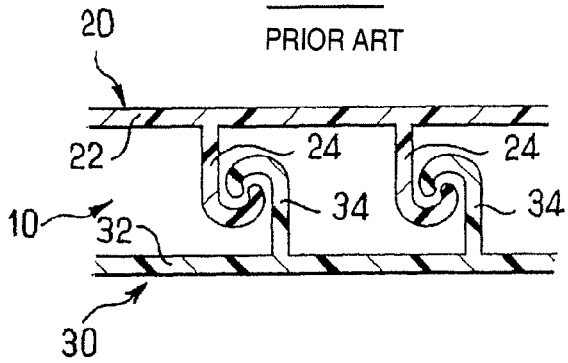
FIG.2 PRIOR ART

FIGS. 1 and 2 show an example of known closure zippers.

These two figures respectively show two closure assemblies 10 each with two complementary zippers 20, 30.

More precisely these two assemblies 10 each have two zippers 20, 30 that include support backing-strips 22, 32 which carry complementary closure elements 24, 34. According to FIG. 1, these elements 24, 34 are formed from complementary male/female structures. According to FIG. 2, these elements 24, 34 are formed from complementary hooks.

Many closure zippers of the type shown in FIGS. 1 and 2 have already been proposed.

Generally, these closure zippers are extrusions made from thermoplastic materials.

However it is proving desirable now, for certain applications, to have bi-material closure zippers, meaning zippers in which the backing-strips 20, 30 and the closure elements 24, 34 are made from different materials. In theory, this should enable one to create closure assemblies that have, for example, different colours or even different degrees of flexibility between the backing-strips 20, 30 and the associated closure elements 24, 34. To this end, an attempt has been made to co-extrude backing-strips 20, 30 and closure elements 24, 34 made from different materials, as shown diagrammatically in FIG. 3 attached, for closure elements 24, 34 of the male/female type.

Up to now however, these attempts have not given total satisfaction. In fact, they present a persistent risk of separation of the closure elements 24, 34 in relation to the support backing-strips 20, 30 when the bags pulled open, or again under the simple effect of pressure inside the bag.

In this context, this present invention has as its objective to perfect the existing resources.

This objective is attained in the context of this present invention by virtue of a closure assembly that includes two complementary zippers respectively with support backing-strips and complementary closure elements, characterised by the fact that at least one of these closure elements includes a widened soleplate which is at least partially surrounded by the associated support backing-strip.

The professional engineer will understand that this arrangement enables the closure element to be retained on the support backing-strip, thereby eliminating any risk of separation between the closure element and the associated support backing-strip.

Figure 3:
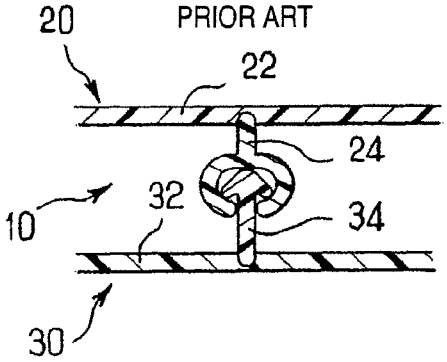
FIG.3 PRIOR ART
Figure 4:
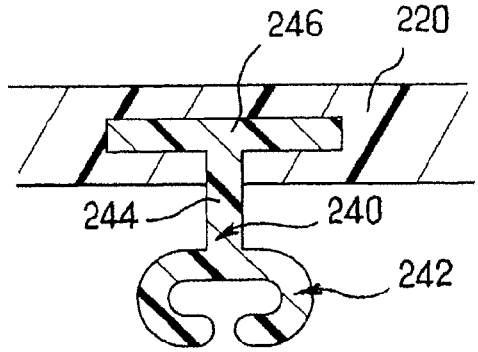

Other characteristics, objectives and advantages of this present invention will appear on reading the detailed description that follows, with reference to the appended drawings, provided by way of non-limiting examples and in which:

FIGS. 1 to 3, described previously, represent closure assemblies according to existing designs, FIG. 4 is a view in cross-section of a closure zipper according to this present invention, and FIGS. 5 to 12 represent diverse variants for the creation of closure zippers according to this present invention.

FIG. 4 shows a closure zipper according to this present invention that includes a closure element 240 of the female type that has a channel 242 with converging edges connected to a rod 244 which is generally perpendicular to the main surfaces of a support backing-strip 220. According to the invention, the rod 244 is equipped, at the end opposite to the channel 242 with converging edges, with a widened soleplate 246 embedded in the mass of the backing-strip 220. In other words the soleplate 246 is totally surrounded by the material of the backing-strip 220. It is located in a cavity formed in the thickness of the backing-strip 220.

Preferably, the backing-strip 220 and the associated closure element 240 shown in FIG. 4 are co-extruded in thermoplastic materials.

The technique of co-extrusion is well known to the professional engineer. It will therefore not be described in detail in what follows.

Figure 5:
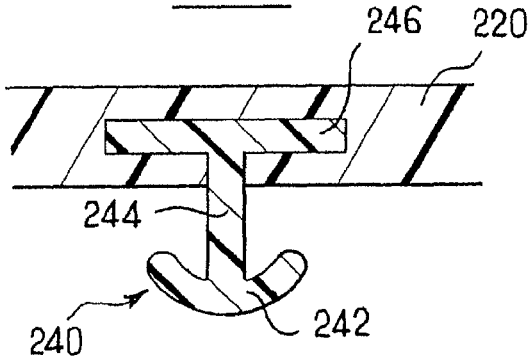
Figure 6:
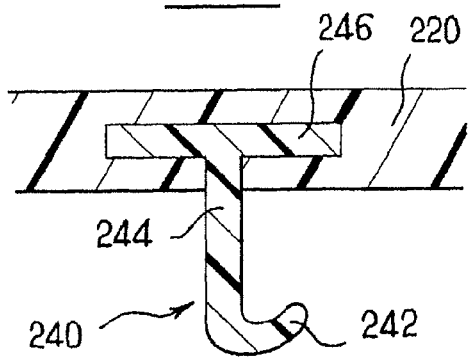

FIGS. 5 and 6 show two variants for the creation of closure zippers according to this present invention, which differ from the zipper shown in FIG. 4 only by the fact that the closure element 240 is composed of an element 242 of the male type in FIG. 5 and an element of the hook type in FIG. 6.

The soleplate 246 lies symmetrically on either side of the rod 244 according to the variants shown in FIGS. 4 to 6.

Figure 7:
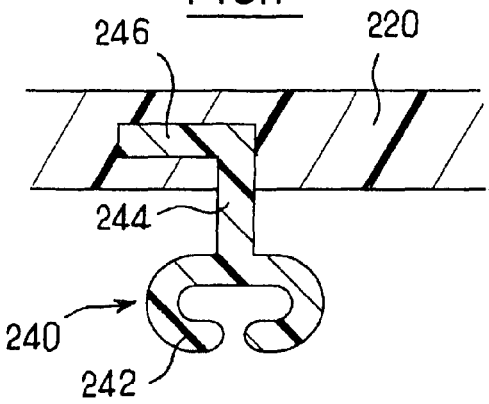

On the other hand, according to the variant shown in FIG. 7, the soleplate 246 is asymmetrical in relation to the rod 244. More precisely, according to FIG. 7, it lies only on one side of the rod 244. According to yet another variant, not shown in the figures so as to simplify the illustration, the soleplate 246 could lie on either side of the rod 244, but along different extensions.

Figure 8:
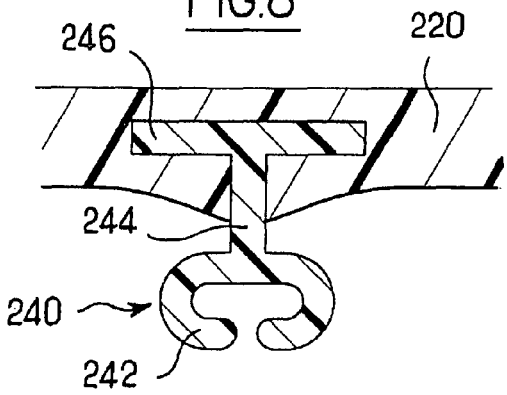

FIG. 8 shows another implementation variant according to which the support backing-strip 220 has a variable thickness at the location of the soleplate 246. More precisely, again according to the implementation variant shown in FIG. 8, the backing-strip 220 has an increasing thickness close to the rod 244. This arrangement is used to strengthen the retention of the closure element 240 on the support backing-strip 220.

Figure 9:
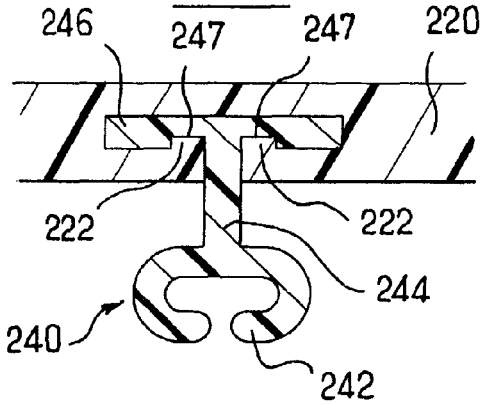

As shown in FIG. 9, where appropriate, structures of complementary shape can be provided, interleaved between the backing-strip 220 and the soleplate 246 in order to reinforce the retention of the closure element 240. More precisely, again according to the method of implementation shown in FIG. 9, at least one low ridge 222 is provided, cast in the material of the support backing-strip 220 and engaged in a complementary channel 247 formed in the soleplate 246. According to FIG. 9, two such low parallel ridges 222 are provided, respectively adjacent to the rod 244 on either side of the latter.

Figure 10:
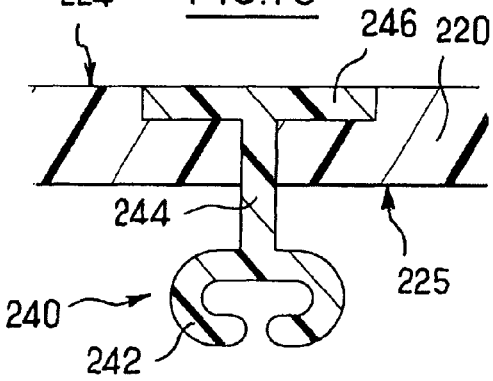

According to the implementation variant shown in FIG. 10 the soleplate 246 is accessible on the face 224 of the support backing-strip 220 opposite to the face 225 of this support backing-strip by which the rod 244 bearing the closure element 242 emerges.

Figure 11:
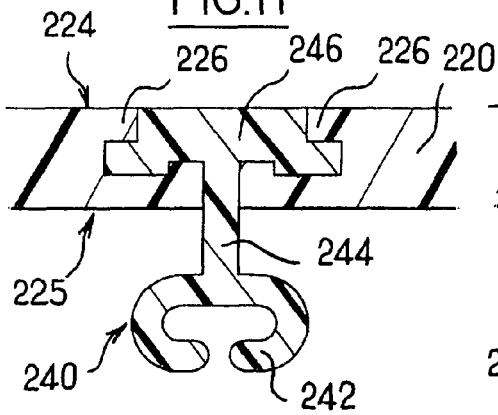

FIG. 11 shows a variant according to which the soleplate 246 emerges on the face 224 of the support backing-strip opposite to the closure element 242. However, according to the variant shown in FIG. 11, at the level of this face 224 of the support backing-strip 220, the soleplate 246 is partially covered by ribs 226 cast in the material of the support backing-strip 220. This arrangement is used to eliminate the risk of extraction of the soleplate 246 via the face 224 of the support backing-strip 220.

Figure 12:
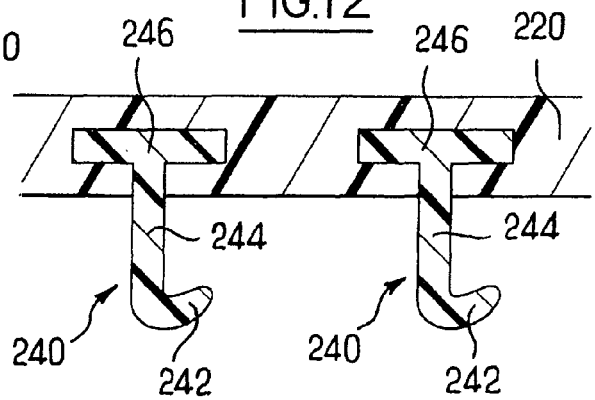

For the hook-type closure elements, FIG. 12 shows that this present invention can apply to support backing-strips 220 that have several closure elements in parallel.

It will be seen that the characteristics of this present invention, according to which at least one of the closure elements includes a soleplate that is at least partially embedded in a support backing-strip, applies either to the creation of closure assemblies as such that are intended to be assembled later and secured onto a film, by welding for example, or to closure assemblies that are directly integrated by extrusion in films that are intended for the design of bags.

This present invention applies in particular to closure assemblies in which the support backing-strips 220 and closure elements 240 are made from different thermoplastic materials. This arrangement is used, for example, to create a support backing-strip 220 and an associated closure assembly 240 in different colours or with different degrees of flexibility.

In this context, the materials making up the support backing-strip 220 and the closure element 240 are advantageously chosen from the group that includes polyethylene, polypropylene and polystyrene.

More precisely and again preferably, according to the invention, the support backing-strip and the associated closure element 240 matching the configurations described previously are preferably chosen from the pairs that include polyethylene and polypropylene or polyethylene and polystyrene.

The implementation variants shown in FIGS. 7 to 11 are illustrated with a closure element 242 of the female type. However the invention is not limited to this arrangement. All the characteristics shown in FIGS. 7 to 11, as well as those illustrated in FIG. 12, are liable of be applied to any type of closure element 242 whether of the female, male or hook type or any other equivalent shape.

In addition, the invention also covers any combination of the characteristics described previously and shown in the appended figures.

The invention claimed is:

1. A closure assembly, having two complementary zippers which respectively include co-extruded support backing-strips (220) and complementary closure elements (242) from thermoplastic materials, wherein at least one of the closure elements in each zipper is integral with a widened soleplate (246), and wherein the associated support backing-strip (220) is co-extruded onto the widened soleplate so that said widened soleplate is located in a cavity formed in the thickness of its associated backing strip and the widened soleplate is embedded in the mass of the associated support backing-strip (220).

2. An assembly according to claim 1, wherein the closure element (242) includes a male element and a female element.

3. An assembly according to claim 1, wherein the closure element including the widened soleplate (246) and its associated support backing-strip (220) are made of different materials.

4. An assembly according to claim 1, wherein the closure element including the widened soleplate (246) and its associated support backing-strip (220) are made of materials of different colour.

5. An assembly according to claim 1, wherein the closure element including the widened soleplate (246) and its associated support backing-strip (220) are made of materials of different flexibility.

6. An assembly according to claim 1, wherein the closure element including the widened soleplate (246) and its associated support backing-strip (220) are made of materials chosen from a group that includes polyethylene, polypropylene and polystyrene.

7. An assembly according to claim 1, wherein the respective materials making up the closure element including the widened soleplate (246) and its associated support backing-strip (220) are made of materials chosen from a group of pairs of materials that includes a) polyethylene and polypropylene or b) polyethylene and polystyrene.

8. An assembly according to claim 1, wherein the soleplate (246) is symmetrical in relation to a rod (244) bearing a closure element (242).

9. An assembly according to claim 1, characterized by the fact that the soleplate (246) is asymmetrical in relation to a rod (244) bearing a closure element (242).

10. An assembly according to claim 1, characterized by the fact that the support backing-strip (220) has a variable thickness at the location of the soleplate (246).

11. An assembly according to claim 10, characterized by the fact that the support backing-strip (220) has an increasing thickness close to the rod (244) of the closure element (240).

12. An assembly according to claim 1, characterized by the fact that the assembly includes structures of complementary shape interleaved into the support backing-strip (220) and the complementary soleplate (246).

13. An assembly according to claim 12, characterized by the fact that the support backing-strip (220) includes at least one low ridge (222) engaged in a complementary channel (247) of the soleplate (246).

14. An assembly according to claim 12, characterized by the fact that the support backing-strip (220) includes two low ridges (222) adjacent to the rod (244) of the closure element, engages in complementary channels (247) formed in the soleplate (246).

15. An assembly according to claim 1, characterized by the fact that the soleplate (246) is accessible on the face (224) of the support backing-strip (220) opposite to the face (225) of the support backing-strip (220) by which the closure element (242) emerges.

16. An assembly according to claim 15, characterized by the fact that the support backing-strip (220) at least partially covers the soleplate (246) on the face (224) opposite to that by which the closure element (242) emerges.

17. An assembly according to claim 1, wherein the closure element (242) includes a hooked structure.

* * * * *